US006296513B1

(12) United States Patent
Ishikawa et al.

(10) Patent No.: US 6,296,513 B1
(45) Date of Patent: Oct. 2, 2001

(54) ELECTRICAL TERMINAL FOR TERMINATING AT LEAST TWO WIRES THEREIN

(75) Inventors: Toshiharu Ishikawa, Tokyo; Mitsuru Suzuki, Kanagawa, both of (JP)

(73) Assignee: Tyco Electronics AMP, K.K., Kanagawa (JP)

( * ) Notice: Subject to any disclaimer, the term of this patent is extended or adjusted under 35 U.S.C. 154(b) by 0 days.

(21) Appl. No.: 09/573,462

(22) Filed: May 17, 2000

(51) Int. Cl.[7] ..... H01R 4/24; H01R 4/26; H01R 11/20

(52) U.S. Cl. ..... 439/403; 439/397

(58) Field of Search ..... 439/403, 402, 439/397, 398, 395

(56) References Cited

U.S. PATENT DOCUMENTS

| | | | | |
|---|---|---|---|---|
| 4,118,103 | | 10/1978 | Leidy et al. | 439/398 |
| 4,127,312 | * | 11/1978 | Fleischhacker et al. | 439/403 |
| 4,648,673 | * | 3/1987 | Endo et al. | 439/395 |
| 5,044,978 | | 9/1991 | Gelin | 439/394 |
| 5,358,423 | * | 10/1994 | Burkhard et al. | 439/402 |

FOREIGN PATENT DOCUMENTS

| | | |
|---|---|---|
| 0 435 292 A1 | 7/1991 | (EP) . |
| 0 571 156 A2 | 11/1993 | (EP) . |
| 2 581 259 | 10/1986 | (FR) . |
| WO 98/47201 | 10/1998 | (WO) . |

OTHER PUBLICATIONS

European Search Report, Application No. EP 00 30 4499 Sep. 19, 2000.

* cited by examiner

*Primary Examiner*—Brian Sircus
*Assistant Examiner*—Javaid Nasri

(57) ABSTRACT

An electrical terminal 1 is provided that is formed by being stamped and bent from a metal plate. This terminal is equipped with a pair of opposing first electrical wire accommodating slots 4 that are respectively formed in a pair of opposing first plate parts 3*a* and 3*b*, and a pair of opposing second electrical wire accommodating slots 8 that are respectively formed in opposing second plate parts 7. The pair of second plate parts 7 are formed by a pair of plate parts that are bent from both side edges of a flat plate part 12 that extends from one of the first plate parts 3*a*, with these plate parts being bent substantially at right angles relative to the flat plate part 12, so that the pair of second electrical wire accommodating slots 8 formed in the second plate parts 7 and the pair of first electrical wire accommodating slots 4 formed in the first plate parts 3*a* and 3*b* are arranged substantially at right angles.

10 Claims, 4 Drawing Sheets

Fig. 1
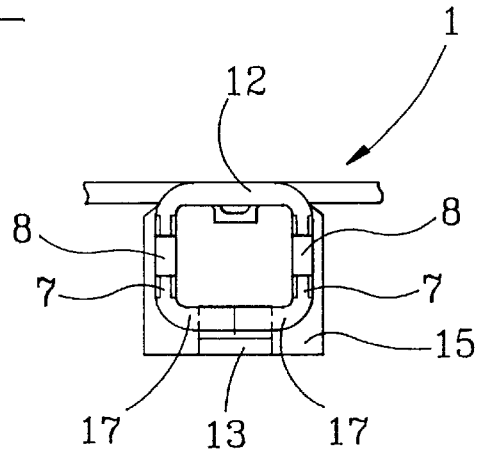
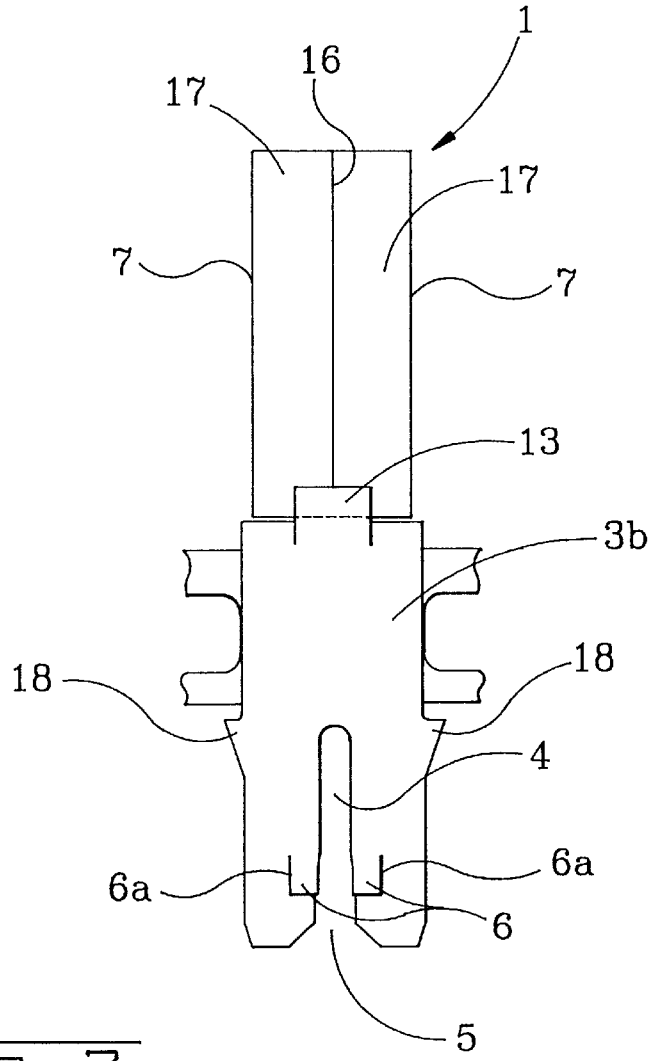
Fig. 2

ELECTRICAL TERMINAL FOR TERMINATING AT LEAST TWO WIRES THEREIN

FIELD OF THE INVENTION

The present invention relates to an electrical terminal which is equipped with first electrical wire accommodating slots that accommodate a first electrical wire extending from an electrical device such as a motor, etc., and second electrical wire accommodating slots that accommodate a second electrical wire that is separate from the first electrical wire, and in which the first electrical wire and second electrical wire are electrically connected.

BACKGROUND OF THE INVENTION

The electrical terminal shown in FIG. 5 is a conventional electrical terminal as disclosed in U.S. Pat. No. 4,118,103. This electrical terminal 100 is formed by stamping and bending a metal plate, and has a pair of opposing plate parts 102 that are connected via a bent part 101. A pair of opposing first electrical wire accommodating slots 103 which are formed in the bottom portions of the plate parts 102 and which accommodate a first electrical wire (not shown in the figures), and a pair of opposing second electrical wire accommodating slots 106 which are formed in the upper portions of the plate parts 102 and which accommodate a second electrical wire (not shown in the figures), are respectively formed in the opposing plate parts 102. First electrical wire accommodating openings 104 which are wider than the first electrical wire accommodating slots 103 are formed so that these openings extend from the bottom ends of the pair of plate parts 102 to the first electrical wire accommodating slots 103, and a pair of protruding edge parts 105 which remove the insulating covering of the first electrical wire are formed on both sides of each first electrical wire accommodating slot 103. Furthermore, folded-back portions 107 which are folded back to the inside toward each other from the respective upper ends of the pair of plate parts 102 are formed, and protruding parts 108 that protrude inward are formed in the respective folded-back portions 107. As a result of the presence of the folded-back portions 107, the thickness of the plate parts 102 which have the second electrical wire accommodating slots 103 is doubled, so that the strength of the plate parts 102 is sufficient when a relatively thick second electrical wire is inserted into these accommodating slots.

The first electrical wire (not shown) is a slender electromagnetic coil conductor which is insulated by varnish, while the second electrical wire (not shown) is a conductor whose core is covered by an insulating outer covering consisting of a synthetic plastic material that is thicker than a varnish covering.

In the case of the electrical terminal 100 shown in FIG. 5, the first electrical wire accommodating slots 103 and second electrical wire accommodating slots 106 formed in the plate parts 102 are respectively formed as pairs of slots. As a result, the first electrical wire accommodated in the first electrical wire accommodating slots 103 and the second electrical wire accommodated in the second electrical wire accommodating slots can be securely connected to the electrical terminal 100, so that the mutual connection of the first and second electrical wires can be securely accomplished.

However, since the first electrical wire accommodating slots 103 and second electrical wire accommodating slots 106 are formed in the same flat plates, the slots are parallel to each other. As a result, the first electrical wire accommodated in the first electrical wire accommodating slots 103 and the second electrical wire accommodated in the second electrical wire accommodating slots 106 are effectively parallel to each other, so that cases in which it is desired to cross the first electrical wire and second electrical wire when the wires are connected to the electrical terminal 100 cannot be handled.

SUMMARY OF THE INVENTION

Accordingly, an object of the present invention is to provide an electrical terminal which makes it possible to achieve a secure electrical connection between a first electrical wire and a second electrical wire, and which makes it possible to connect the first electrical wire and second electrical wire at right angles to one another.

The electrical terminal of the present invention is formed by being stamped and bent from a metal plate, and is equipped with a pair of opposing first electrical wire accommodating slots which are respectively formed in a pair of opposing first plate parts, and a pair of second electrical wire accommodating slots which are respectively formed in a pair of opposing second plate parts, such that a first electrical wire may be accommodated in the first electrical wire accommodating slots and a second electrical wire may be accommodated in the second electrical wire accommodating slots. The first electrical wire and the second electrical wire are electrically connected. The pair of second plate parts are formed by a pair of plate parts which are bent from both side edges of a flat plate part extending from one of the first plate parts, with these plate parts being bent substantially at right angles with respect to the flat plate part, and the pair of second electrical wire accommodating slots formed in the second plate parts and the pair of first electrical wire accommodating slots formed in the first plate parts cross each other substantially at right angles.

Furthermore, it is effective if a stopper part, which restricts the movement of the second plate parts to the outside when the second electrical wire is accommodated in the second electrical wire accommodating slots, is formed on the first plate part that is opposite the first plate part from which the flat plate part extends.

Furthermore, it is effective if a reinforcing bead part which reinforces the flat plate part is formed on the flat plate part.

BRIEF DESCRIPTION OF THE DRAWINGS

An embodiment of the present invention will now be described by way of example with reference to the following drawings, in which:

FIG. 1 is a plan view of the electrical terminal of the present invention;

FIG. 2 is a front view of the electrical terminal shown in FIG. 1;

DETAILED DESCRIPTION OF THE INVENTION

Figure 3:
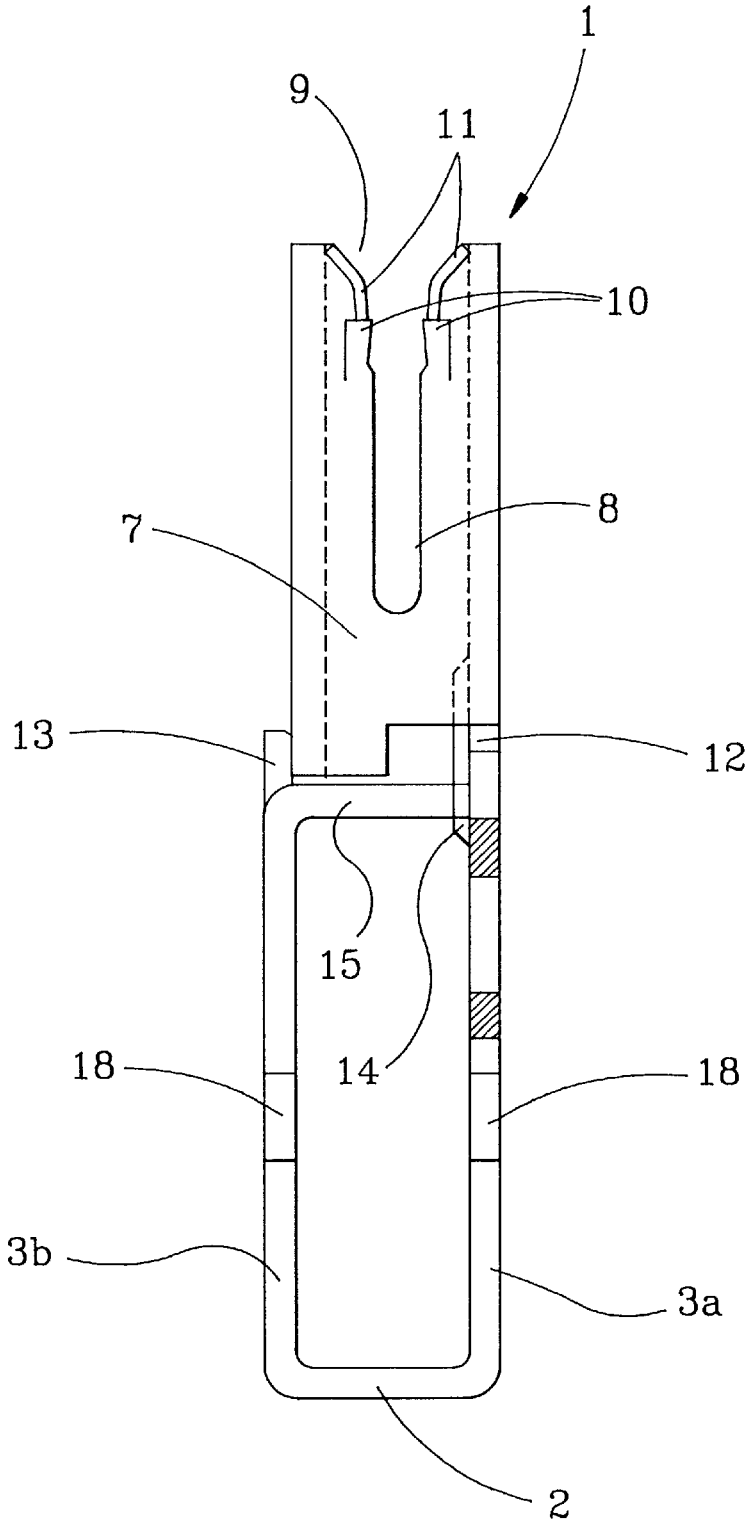
FIG. 3 is a side view of the electrical terminal shown in FIG. 1.

As shown in FIGS. 1 through 3, the electrical terminal 1 is formed by stamping and bending a metal plate, and has a pair of opposing first plate parts 3*a* and 3*b* that are connected via a connecting part 2. A pair of opposing first electrical wire accommodating slots 4 which accommodate a first electrical wire (not shown in the figures) are respectively formed in the pair of first plate parts 3*a* and 3*b*. The first electrical wire may be, for example, a relatively slender electrical magnetic coil conductor insulated by means of a varnish, which extends from an electrical device such as a motor, etc. First electrical wire accommodating openings 5 which are wider than the first electrical wire accommodating slots 4 are formed so that these openings 5 extend from the lower ends of the pair of first plate parts 3*a* and 3*b* to the first electrical wire accommodating slots 4, and a pair of protruding edge parts 6 which remove the insulating covering of the first electrical wire when the first electrical wire is accommodated are formed on both sides of each first wire accommodating slot 4. The protruding edge parts 6 are formed by cutting along L-shape cutting lines 6*a* on both sides of each first electrical wire accommodating slot 4, and pressing the cut portions from both sides so that the edge parts are caused to protrude slightly into the first electrical wire accommodating slots 4. A pair of engaging projections 18 which engage with an insulating housing (not shown in the figures) are formed on the respective side edges of the pair of first plate parts 3*a* and 3*b*.

The electrical terminal 1 has a pair of opposing second plate parts 7 that are distanced from the first plate parts 3*a* and 3*b*. The pair of second plate parts 7 are formed by a pair of plate parts that are bent from both side edges of a flat plate part 12 that extends upward from one of the first plate parts 3*a*, with these plate parts being bent substantially at right angles relative to the flat plate part 12. A pair of opposing second electrical wire accommodating slots 8 that accommodate a second electrical wire (not shown in the figures) are respectively formed in the second plate parts 7. The second electrical wire accommodating slots 8 and first electrical wire accommodating slots 4 are oriented substantially at rightangles to one another. The second electrical wire may be a conductor in which the circumference of the core is covered with a relatively hard Teflon as an insulating covering. Second electrical wire accommodating openings 9 are formed so that these openings 9 extend from the upper ends of the pair of second plate parts 7 to the second electrical wire accommodating slots 8. Knife edges 11 are used for efficient cutting of the Teflon covering of the second electrical wire and are formed on the edge parts of the second wire accommodating openings 9. A pair of protruding edge parts 10 which remove the insulating covering of the second electrical wire when the second electrical wire is inserted into the second electrical wire accommodating slots 8 are formed on both sides of each of the second electrical wire accommodating slots 8. Moreover, the tip end portions 17 of the pair of second plate parts 7 are bent inward toward each other and joined by a seam 16, so that a box-form shape is constructed. As a result, the pair of second plate parts 7 in which the second electrical wire accommodating slots 8 are formed are structurally strengthened.

The upper end portion 15 of the other first plate part 3*b* that is opposite the first plate part 3*a* from which the flat plate part 12 extends is bent substantially at right angles toward the first plate part 3*a* from which the flat plate part 12 extends, and the tip end of this other first plate part 3*b* is caused to contact the first plate part 3*a* from which the flat plate part 12 extends. As a result, the pair of first plate parts 3*a* and 3*b* in which the first electrical wire accommodating slots 4 are formed are structurally strengthened. Furthermore, a stopper part 13 which restricts the movement of the second plate parts 7 to the outside when the second electrical wire is accommodated in the second electrical wire accommodating slots 8 is formed as a protruding part on the other first plate part 3*b*. The stopper part 13 contacts the bent tip end portions 17 of the second plate parts 7 before the second electrical wire is accommodated in the second electrical wire accommodating slots 8. Meanwhile, a reinforcing bead part 14 which reinforces the flat plate part 12 extending from the opposite first plate part 3*a* is formed on the flat plate part 12.

Figure 4:
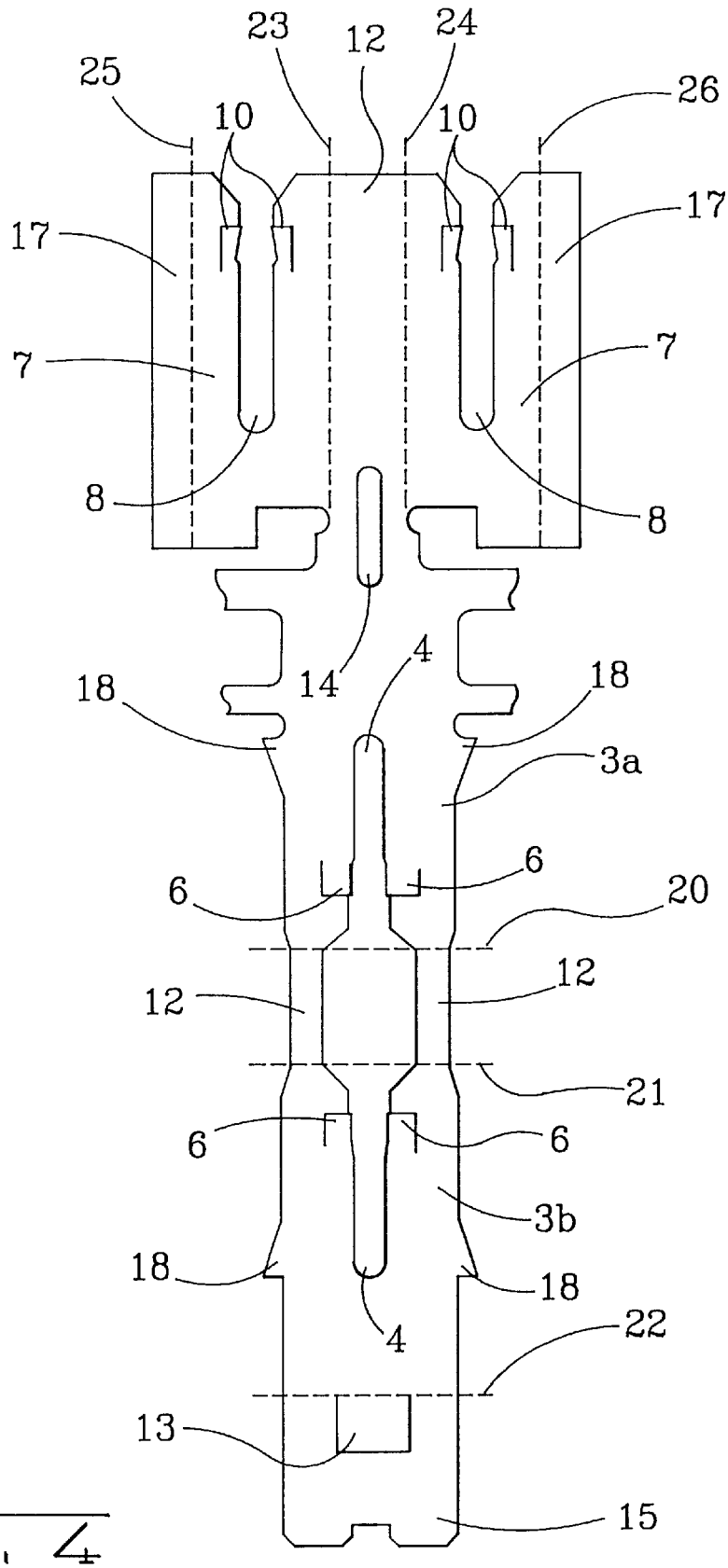
FIG. 4 is a plan view of the metal plate stamping blank used to form the electrical terminal shown in FIG. 1.
Figure 5:
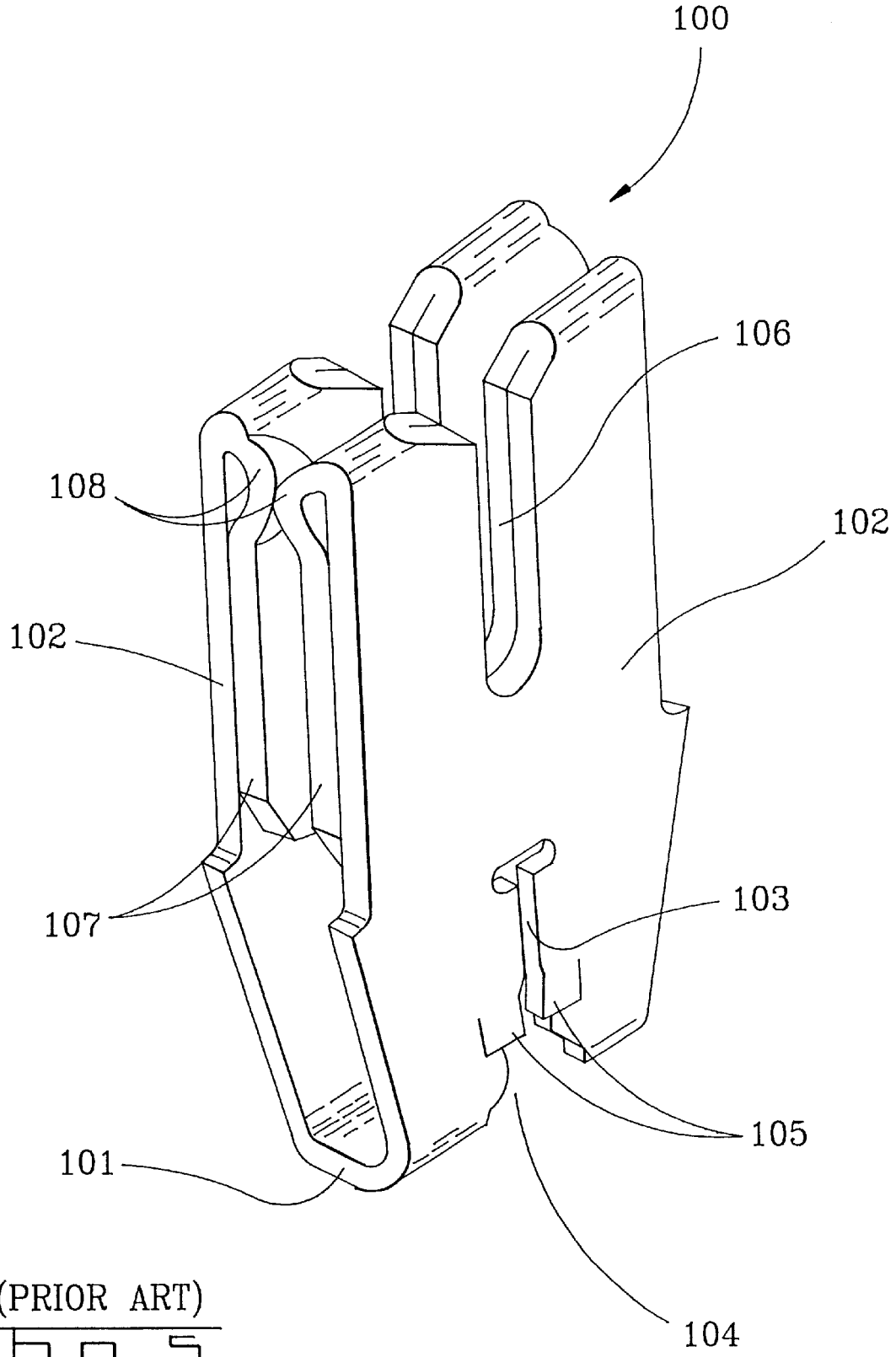
(PRIOR ART) Fig. 5
FIG. 5 is a perspective view of a conventional example of an electrical terminal.

The electrical terminal 1 is stamped from a metal plate in the shape shown in FIG. 4, and is formed by bending the pair of first plate parts 3*a* and 3*b* along the bending lines 20 and 21, bending the upper end portion 15 of one of the first plate parts 3*b* along the bending line 22, bending the pair of second plate parts 7 along the bending lines 23 and 24, and bending the tip end portions of the second plate parts 7 along the bending lines 25 and 26.

The electrical terminal 1 constructed as described above is attached to a motor-side insulating housing (not shown in the figures) by press-fitting the engaging projections 18 with the first electrical wire accommodating openings 5 facing downward. The first electrical wire extending from the motor is disposed in the insulating housing beforehand, and when the electrical terminal 1 is attached to the insulating housing, the first electrical wire is accommodated in the first electrical wire accommodating slots 4 from the first electrical wire accommodating openings 5, so that this first electrical wire is electrically connected to the electrical terminal 1. In this case since the upper end portion 15 of the aforementioned other first plate part 3*b* is bent substantially at right angles toward the opposite first plate part 3*a* and the tip end of this other first plate part 3*b* is caused to contact the opposite first plate part 3*a* so that the pair of first plate parts 3*a* and 3*b* in which the first electrical wire accommodating slots 4 are formed, are structurally strengthened, the first plate parts 3*a* and 3*b* are not deformed by press-fitting in the insulating housing.

After the electrical terminal 1 has been fastened to the insulating housing, the second electrical wire which is fastened in place, for example, by means of an insulating cover, is inserted into the second electrical wire accommodating slots 8 from the second electrical wire accommodating openings 9, so that the second electrical wire is electrically connected to the electrical terminal 1. As a result, the first electrical wire and second electrical wire are electrically connected to each other by the electrical terminal 1. Since the pair of second electrical wire accommodating slots 8 formed in the second plate parts 7 and the pair of first electrical wire accommodating slots 4 formed in the first plate parts 3*a* and 3*b* are arranged substantially at right angles, the first and second electrical wires accommodated in these slots are disposed so that they are oriented at right angles. Furthermore, since the first electrical wire accommodating slots 4 and second electrical wire accommodating slots 8 are respectively formed as pairs of slots rather than as single slots, the first and second electrical wires are securely connected to the electrical terminal. Moreover, since a reinforcing bead part 14 which reinforces the flat plate part 12 that connects the first plate parts 3*a* and second plate parts 7 is formed on the flat plate part 12, there is little danger that the flat plate part 12 will bend when the second electrical wire is inserted in the second electrical wire accommodating slots 8. Furthermore, since a stopper part 13 which restricts the movement of the second plate parts 7 to the outside (in a direction away from the flat plate part 12) when the second electrical wire is accommodated in the second electrical wire accommodating slots 8 is formed on the other first plate part 3*b* that is opposite the first plate part 3*a* from which the flat plate part 12 extends, the movement of the second plate parts 7 is restricted even if the second plate parts 7 should tend to bend to the outside about the flat plate part 12. Accordingly, the connection of the second electrical wire to the electrical terminal 1 is securely accomplished.

An advantage of the present invention is that a pair of second plate parts are formed by a pair of plate parts which are bent from both side edges of a flat plate part extending from one first plate part, with these plate parts being bent substantially at right angles relative to the flat plate part, so that a pair of second electrical wire accommodating slots formed in the second plate parts and a pair of first electrical wire accommodating slots formed in the first plate parts are oriented substantially at right angles. Accordingly, the first electrical wire and second electrical wire can be connected by being arranged at right angles. Furthermore, since the first electrical wire accommodating slots and second electrical wire accommodating slots are respectively formed as pairs of slots, the mutual connection of the first electrical wire and second electrical wire via the electrical terminal can be securely accomplished.

A further advantage of the present invention is that a stopper which restricts the movement of the second plate parts to the outside when the second electrical wire is accommodated in the second electrical wire accommodating slots is formed on the other first plate part that is opposite the first plate part from which the flat plate part extends. Accordingly, even if the second plate parts should tend to bend to the outside about the flat plate part when the second electrical wire is accommodated, the movement of the second plate parts is restricted by the stopper part, so that the connection of the second electrical wire to the electrical terminal can be securely accomplished.

A further advantage of the present invention is that a reinforcing bead part which reinforces the flat plate part is formed on the flat plate part. Accordingly, there is little danger that the flat plate part will bend when the second electrical wire is inserted into the second electrical wire accommodating slots.

The electrical terminal of the present invention and many of its attendant advantages will be understood from the foregoing description. It is apparent that changes may be made in the form, construction, and arrangement of parts thereof without departing from the spirit of the invention, or sacrificing all of its material advantages. Thus while embodiments of the invention have been disclosed, it is to be understood that the invention is not strictly limited to these embodiments but may be otherwise variously embodied and practiced within the scope of the appended claims.

What is claimed is:

1. A stamped and formed electrical terminal, comprising:

a pair of opposing first electrical wire accommodation slots which are respectively formed on a pair of opposing first plate parts;

a pair of second electrical wire accommodating slots which are respectively formed in a pair of opposing second plate parts;

a stopper part extending from a second respective first plate part, the stopper part cooperates with the pair of second plate parts and restricts movement thereof;

wherein the pair of second plate parts are bent at substantially right angles from both side edges of a flat plate part extending from a first respective first plate part; and the pair of second electrical wire accommodating slots formed in the second plate parts are disposed at substantially right angles to the pair of first electrical wire accommodating slots formed in the first plate parts.

2. The stamped and formed electrical terminal claimed in claim 1, wherein the stopper part lies over a seam along the second plate parts, the stopper part prevents the movement of the second plate parts in a direction away from the flat plate part.

3. The stamped and formed electrical terminal claimed in claim 1, wherein a reinforcing bead is formed on said flat plate part and underlies an end portion of one of the first plate parts which is bent toward the other first plate part and prevents the electrical terminal from collapsing.

4. A stamped and formed electrical terminal for connecting a first wire and a second wire at substantially right angles, the electrical terminal comprising:

a pair of opposing first plate portions having first wire accommodating slots to receive the first wire;

a flat plate portion extending from a first respective first plate portion;

a pair of opposing second plate portions having second wire accommodating slots to receive the second wire, the pair second plate portions extending at substantially right angles from both side edges of the flat plate portion; and a stopping member extending from a second respective first plate portion which cooperates with the pair of second plate portions to prevent the movement of the pair of second plate portions in a direction away from the flat plate portion.

5. The stamped and formed electrical terminal of claim 4, wherein the second respective first plate portion has an end portion that is bent back toward and abuts the first respective first plate portion.

6. The stamped and formed electrical terminal of claim 5, wherein the first respective first plate portion has a reinforcing portion which contacts the end portion and prevents collapse of the electrical terminal.

7. The stamped and formed electrical terminal of claim 4, wherein the second plate portions have tip end portions which are bent at right angles from the second plate portions to form a seam therebetween.

8. The stamped and formed electrical terminal of claim 7, wherein the stopping member overlies the seam between the tip end portions.

9. The stamped and formed electrical terminal of claim 4, wherein the first wire accommodating slots and the second wire accommodating slots have edge parts for cutting insulation on the first wire and the second wire.

10. The stamped and formed electrical terminal of claim 4, wherein the first plate portions have projections for retaining the electrical terminal in a housing.

* * * * *